US008196370B2

(12) United States Patent
Scheckler

(10) Patent No.: US 8,196,370 B2
(45) Date of Patent: Jun. 12, 2012

(54) MASONRY CONSTRUCTION USING SINGLE-COMPONENT POLYURETHANE FOAM

(75) Inventor: Addison C. Scheckler, Cato, NY (US)

(73) Assignee: Calmar Holdings LLC, Cato, NY (US)

( * ) Notice: Subject to any disclaimer, the term of this patent is extended or adjusted under 35 U.S.C. 154(b) by 0 days.

(21) Appl. No.: 12/878,070

(22) Filed: Sep. 9, 2010

(65) Prior Publication Data

US 2011/0061335 A1 Mar. 17, 2011

Related U.S. Application Data

(60) Provisional application No. 61/241,879, filed on Sep. 12, 2009.

(51) Int. Cl.
*E04B 1/00* (2006.01)
*E04G 21/00* (2006.01)
*E04G 23/00* (2006.01)

(52) U.S. Cl. ..... 52/747.1; 52/745.1; 52/745.13; 52/745.21

(58) Field of Classification Search ..... 52/741.13, 52/745.09, 745.1, 745.13, 745.21, 747.1, 52/747.12, 561
See application file for complete search history.

(56) References Cited

U.S. PATENT DOCUMENTS

| | | | | |
|---|---|---|---|---|
| 4,619,702 | A * | 10/1986 | Gartner | 106/757 |
| 4,990,543 | A * | 2/1991 | Wernsing et al. | 521/129 |
| 5,870,861 | A * | 2/1999 | Gnaedinger | 52/93.1 |
| 5,937,610 | A * | 8/1999 | Behunin | 52/741.1 |
| 2004/0006943 | A1 * | 1/2004 | Weick | 52/315 |
| 2004/0053032 | A1 * | 3/2004 | Weingartner | 428/304.4 |
| 2006/0070328 | A1 * | 4/2006 | Robinson | 52/503 |
| 2007/0054972 | A1 * | 3/2007 | Braun et al. | 521/125 |
| 2009/0038262 | A1 * | 2/2009 | Marschke | 52/793.11 |

* cited by examiner

*Primary Examiner* — Brian Glessner
*Assistant Examiner* — Brian D Mattei
(74) *Attorney, Agent, or Firm* — Bernhard P. Molldren, Jr.

(57) ABSTRACT

A masonry wall is constructed of multiple courses of bricks, concrete blocks or other masonry units. A single-component urethane foam material is employed as bonding agent and is applied to the facing surfaces of the masonry units. The single-component material cures by absorbing water from its environment. The material sets up slowly to permit the mason to adjust positions of the masonry blocks, and cures to hardness in about a day. The amine in the single component material exchanges water molecules from alumina in the masonry units, and permits strong alumina-amine bonding.

10 Claims, 2 Drawing Sheets

MASONRY CONSTRUCTION USING SINGLE-COMPONENT POLYURETHANE FOAM

Applicant claims priority of U.S. provisional application Ser. No. 61/241,879, filed Sep. 12, 2009, pending.

BACKGROUND OF THE INVENTION

This invention relates to masonry wall construction, and is more particularly directed to a process of creating a wall or similar structure of masonry units which has an increased tensile strength and is able to better withstand environmental stresses such as wind and/or thermal stress loading. In particular, the invention concerns a masonry system in which the bricks, concrete blocks, cinder blocks, stones, or other masonry units are bonded together using an amine-based polymeric foam, such as a water-activated urethane (e.g., single component polyurethane) rather than conventional mortar. An example is a product from Dow Corporation, namely an insulating foam sold under the trademark "Great Stuff".

Masonry walls are typically erected using masonry blocks or bricks, arranged in linear courses, and a portland-cement based mortar is used as a bonding agent between the masonry blocks of each course. Mortar is also used between successive courses. Mortar, typically composed of portland cement, lime, and sand, has been preferred because of its superior strength under compression. However, mortar has almost no tensile strength, and additional measures, i.e., pre-stressing techniques, have to be taken to account for the tension forces that occur due to wind loading and other factors.

Masonry walls, e.g., walls formed by stacking concrete blocks, are a common construction method. Such walls have high compression strength but very little tensile strength. As a consequence, it is common to shore concrete block walls during construction, at least until the roof trusses and roof are in place, so that wind does not blow them over. The additional structure is necessary to provide lateral support and to add weight, loading the wall compressively. In high wind areas, i.e., hurricane zones, it is common to require that the top plate of the wall be through-bolted to the foundation slab, so that there is always a net compressive force on the wall. Conventional concrete block walls also experience problems that arise from the extreme rigidity of the conventional concrete-mortar bond. When subjected to minor earth movement or to excessive temperature differentials across the wall, there is a tendency for the wall to relieve stress by cracking along the mortar joints. This produces the familiar stair-step crack. These stresses can lead to spalling and other surface damages, as well as deep cracks that affect the integrity of the masonry structure.

Wind has two effects on a masonry building: side wall pressure and aerodynamic lift of the roof. These can add so that the load on the wall becomes negative, with a result of building collapse. In high wind areas, draw bolts run vertically from the plate (on top of the wall) to the foundation. These bolts have to be tightened so as to load the wall compressively above the normal load of the building, so that there is a positive load on the wall for most wind conditions.

Composite wall structures have been proposed in which building blocks such as concrete blocks, are stacked to form a wall, and a polyurethane foam is applied to fill the hollows of the blocks and the spaces within the blocks. The previous use of polyurethane foam simply formed a mechanical bond with the surface structure of the masonry material. One proposed composite wall structure is discussed in U.S. Pat. No. 4,315,391 to Piazza. Another composite wall system is discussed in U.S. Pat. No. 3,653,170 to Sheckler. The Sheckler insulated masonry block design is an appropriate highly energy-efficient and low permeability alternative to the conventional masonry block, and can be constructed in the same dimensions, e.g., 8×8×16 inches.

The use of a two-component polyurethane adhesive in masonry work is discussed, for example, in U.S. Pat. No. 5,951,796 to Murray, U.S. Pat. No. 5,362,342 to Murray et al., and U.S. Pat. No. 6,164,021 to Huber et al. This prior art advocates for two-component polyurethane systems, i.e., those which require an isocyanate component and a polyol component to be blended immediately before application. The prior art avoids the use of moisture-cured single component urethane systems because of perceived disadvantages of slow set time, slow cure rate, high cost per unit weight, and limited shelf life. The prior art entirely misses advantages that the inventor has discovered that arise from chemistry of the urethane formation. That is, the prior art does not recognize the tendency of the amines in the urethane material to bond with the aluminum oxide in the masonry units, and does not recognize that the single component material will have a tendency to strip the water molecules away from the aluminum oxide molecules so that this bonding can take place strongly. The alumina-amide bond strength can be 500% the tensile strength of the urethane material, but this has not been recognized in the masonry arts.

OBJECTS AND SUMMARY OF THE INVENTION

Accordingly, it is an object of the present invention to provide a process for constructing a masonry wall that avoids the drawbacks of the prior art.

It is a more particular object to provide a process for constructing a masonry wall without need for conventional mortar, and which achieves superior performance in terms of wind loading strength.

It is a particular object to localize thermal expansion of the basic unit block(s), thus avoiding the cumulative expansion common in mortar-bonded structures.

Another object is to provide a wall in which there is improved tensile strength in the bond between masonry units.

A further object is to avoid costly need for draw bolts, prestressing cables, or other means that add compressive loads to the wall.

A water activated urethane closed cell foam adhesive can be used to bond the masonry blocks to one another to form a wall of greatly increased tensile strength and bending strength, so that the wall is much less susceptible to fracture from high wind loads or from thermal stresses. The masonry blocks bonded together with the water activated urethane closed cell foam adhesive also exhibit significant flexural strength. The wall constructed in this way is weather tight, being resistant to penetration by wind or water. A building constructed with masonry walls in this way can be expected to have much improved longevity. Masonry units adhered with closed cell urethane foam will yield a stronger and more energy efficient building.

In accordance with one aspect of the present invention, a wall is constructed of multiple courses of masonry blocks, with each of the blocks being formed of a material composed at least partly of aluminum oxide. A bonding agent is placed between facing surfaces of said blocks, the bonding agent being single component urethane foam material of the type which following application cures by absorbing moisture from its environment, i.e., atmospheric moisture and water from other materials with which it is in contact. The wall is constructed by setting a first course of these masonry blocks; then applying onto the blocks of the first course an amount of the single component urethane foam material; and then setting additional masonry blocks onto the first course, to form a second course of said masonry blocks. The masonry blocks adhere together by means of the single component urethane foam material. The foam material is also applied onto facing surfaces between the blocks of each course. Third, fourth, and further courses of blocks are set up on the same manner. The single component urethane foam material cures in place between said masonry blocks to form said wall.

The amide component of the foam material bonds strongly with the alumina component in the bricks or blocks. The bonding material, being foam, penetrates into crevices and irregularities in the surface of the brick or block, so that the bonding is distributed over a large area. Also, the small bubble structure of the foam allows for a quasi-elastic, or pseudo-elastomeric action. The foam seals spaces between blocks, and has very low $H_2O$ permeability, reducing the impact of frost heave from moisture collecting in spaces between blocks.

The amine radical bonds extraordinarily well with the aluminum oxide. The foam does two things: it expands to fill all the bond void, therefore ensuring a maximum bonding; and the foam creates a pseudo elastomer which then localizes the strain (from wind load, thermal expansion, etc.) to the single masonry unit (block or brick), rather than summing up the strain of all the blocks in the wall, as is the case with the traditional portland-cement based mortar. These effects strengthen the wall and eliminate cracking as a means of strain relief.

This is a significant improvement over any prior foam-based masonry technique, in which the foam simply fills into pores in the blocks and mechanically locks the blocks together to form a masonry wall.

The foam is also an excellent bonding agent for styrene foam insulation or other foam insulation which is applied to the masonry face of a composite masonry block.

The strength of the amine foam-alumina bond can be modified by increasing the foam density. However, a practical limit is the tensile strength of the masonry unit itself, which will be the limit to the strength of the masonry wall.

A sill plate or other wood plate can be affixed on top of the wall, by first applying an amount of the single component urethane foam onto an upper surface of an uppermost course. Then the wood plate is laid atop said uppermost course. The plate adheres to the upper course of the wall by means of the single component urethane foam material. A composite synthetic lumber sill plate may be used to advantage here (i.e., formed of re-cycled plastic resin mixed with wood fibers) which will bond readily to the urethane foam.

The inventor has discovered that the bond between the urethane foam material and the masonry units is exceptionally strong, because the single component urethane foam material displaces water molecules that had been attached to molecules of the aluminum oxide component of the masonry blocks. That is, the alumina is normally hydrated, but the single component material robs it of the water molecules, and converts it to anhydrous form. This permits the amines in the single component material to bond with the aluminum oxide in the masonry blocks. The aluminum oxide has a very strong affinity for polar molecules such as water or the amine radical. The amine radical has a strong enough affinity for the aluminum oxide that it will displace the water from the aluminum oxide molecules. As a consequence, amines, and in particular bonding polymers which contain amines, such as polyurethane, are particularly good candidates as bonding agents in place of the traditional mortar.

A single-component system has a "dry" component that is driven by a propellant (which also causes the foaming) from a sealed container. This reacts with water vapor in the air to effect polymerization. Because of its affinity for water, when the dry component contacts the surfaces of the masonry blocks, it will draw off the water molecules that otherwise bond to the $Al_2O_3$, and this permits the amine in the dry component to gain intimate contact with the $Al_2O_3$.

The construction can also be carried out under somewhat wet conditions also without compromising the strength of the resulting masonry wall. Normally, concrete blocks should be dry before applying synthetic material as a bonding agent, and especially so if employing a two component urethane adhesive. However, because of the affinity of the single component system for environmental moisture, small to moderate amounts of water on the building materials will not present any problem when the process of this invention is used.

A specific application for this technique can involve creating a masonry unit from a pair of pre-formed concrete plates, each a nominal 2×16×8 inches, with a core layer of a foam of 4×16×8 inches sandwiched between them, using a water activated urethane foam adhesive to bond these. In this structure, the flexibility of the core has the effect of significantly reducing the brittle nature of the block construction. The chemical bond between the urethane and concrete is so strong that there is significant tensile strength and bending strength in block walls formed of these composite blocks, as well as in the blocks themselves.

This method can also be used with non-standard shaped masonry units, e.g., stone, with the units being placed together in a more random fashion, rather than in standard courses of blocks, and with the single-component material being applied between the stones or other masonry units.

The amine radical in the urethane has a higher affinity for the oxygen of the alumina than does the water molecule which is normally bonded there, and thus replaces the water molecule with a strong bond.

Whereas mortar-bonded masonry is monolithic, if mortar is used to bond the masonry building units, the use of foam bonding of the present invention converts the masonry structure to a polylithic structure. That is, the unit concrete block or other masonry elements are separated by a strong pseudo-elastomer, and the stresses associated with temperature differentials are not summed.

In this case, the significantly higher tensile strength makes the structure more storm-resistant and earthquake-resistant, as the building roof is connected to the foundation by the tensile strength of the wall(s).

On the other hand, little if any of the compressive strength of the masonry construction is lost. This comes about because each block or building unit is not smooth, but is formed of numerous bumps, ridges and voids, resulting in high spots on the block surfaces. The high points of mating blocks prevent the foam bonding layer from compressing. At the same time, because the foam bond strength is inversely related to the bond thickness, the adhesion strength is very good at these high points.

The above and many other objects, features, and advantages of this invention will be more fully appreciated from the ensuing description of a preferred embodiment, which is to be read in conjunction with the accompanying Drawing.

DETAILED DESCRIPTION OF A PREFERRED EMBODIMENT

Figure 1:
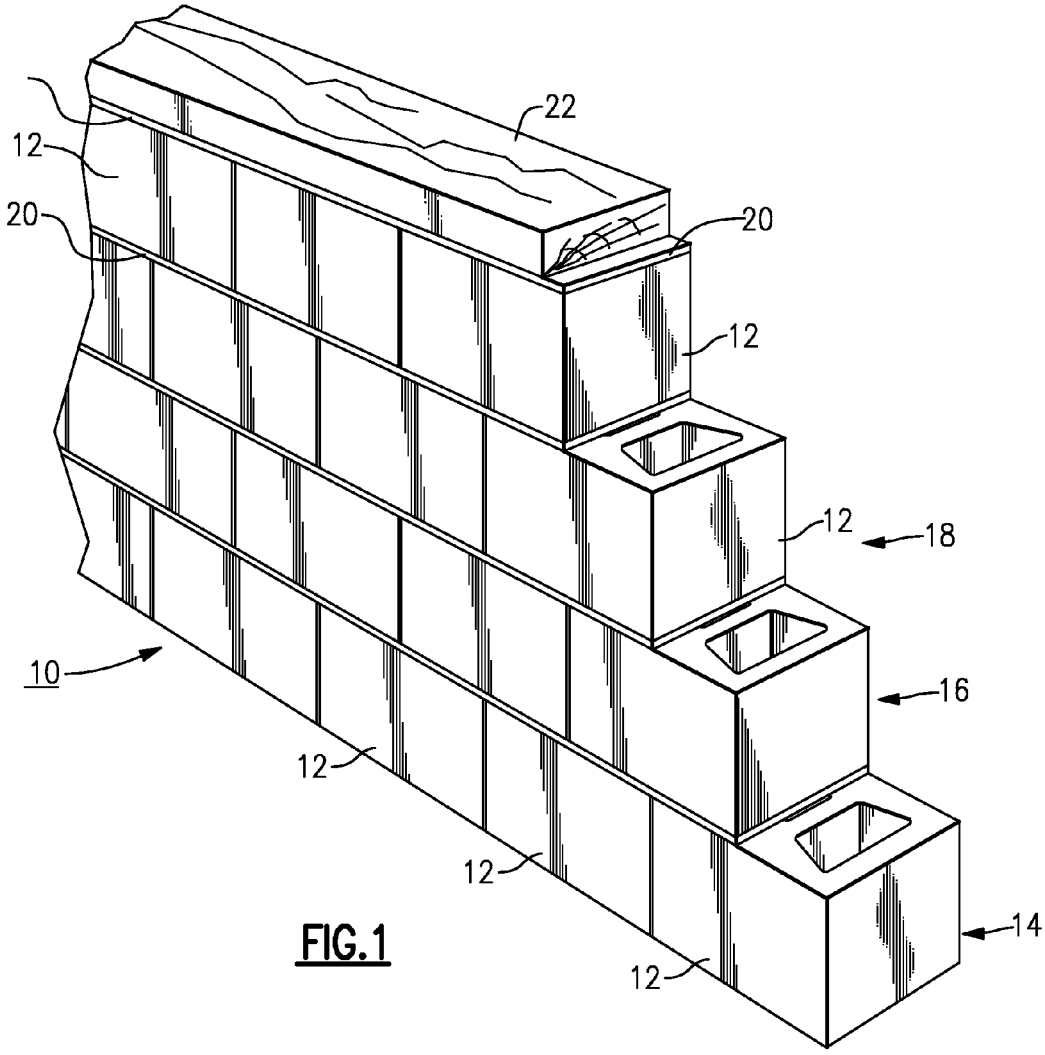
FIG. 1 is a perspective view of a masonry wall constructed according to one embodiment of the invention.

With reference now to the Drawing, FIG. 1 shows a masonry wall 10 under construction, in which there are masonry blocks 12 set into first, second, and third tiers 14, 16, 18 or courses, as is conventional. The masonry blocks here are concrete blocks, but other masonry units could be used. Each of these blocks is formed of a material composed at least partly of alumina, i.e., aluminum oxide or $Al_2O_3$. In an open environment, the alumina molecules at the exposed surfaces of the material bond strongly to water molecules, because of the strong dipole moment of the $H_2O$ molecules and the polarized nature of the $Al_2O_3$ molecules.

A bonding agent 20 is present in the interface between the courses 14, 16 and 16, 18 and between the blocks 12 of each course. In a conventional masonry wall, a standard portland cement based mortar would be used. However, in this embodiment, the bonding agent 20 is a single-component polyurethane incorporating an expanding agent so that the polyurethane material expands to occupy the spaces between these blocks 12. The single-component urethane material absorbs water from the environment, typically water vapor from the ambient air, but will also displace the water molecules that are present on the hydrated alumina in the masonry block material. The wall can be continued to close off a space to serve as a foundation wall.

A wood sill plate 22 is affixed to the top course of blocks. The sill plate 22 serves as the basis for attaching any framing for superstructure above the wall. The sill plate 22 is cemented to the blocks of the top course by applying the single-component urethane material bonding agent 20. This material adheres strongly to the wood as well as to the masonry material of the blocks, and forms a durable bond with high tensile strength and high shear strength. The bond to the wood is not as strong as the block-to-block bond, but it is nevertheless very high strength. The draw bolts that are typically used in conventional mortar construction to hold down the sill plate 22 can be omitted in this construction technique.

Figure 2:
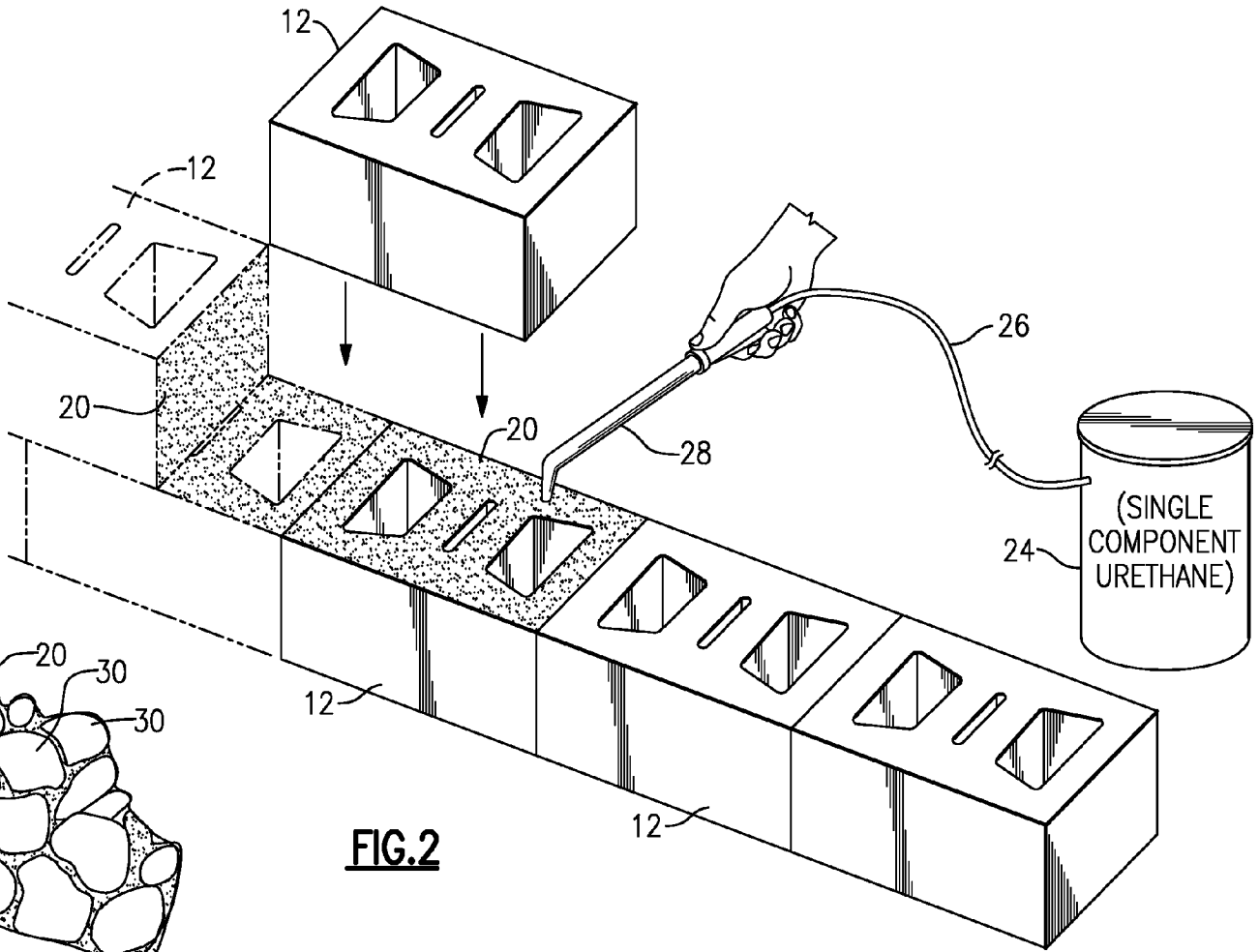
FIG. 2 is an assembly view for explaining the process of this embodiment.

The process of building a wall 10 of concrete blocks 12 or equivalent masonry units is shown in FIG. 2. The first course 14 is set out with the blocks 12 placed end to end. The facing end surfaces of the successive blocks are cemented by applying the single-component closed-cell foam urethane material 20. Then the second course 16 is formed by applying the material 20 onto the top surfaces of the blocks of the first course, and to end surface of the previous block of the second course 16. Then the next block 12 is positioned, as shown. The relatively slow cure time for the single-component urethane material (as compared with two component material) works to advantage in that it permits time for the mason to adjust the positions of the blocks. As shown in FIG. 2, a sealed tank 24 contains the single component material in dry form, i.e., unexposed to moisture, and this is connected via a flexible hose 26 to a nozzle or similar tool 28 through which the mason can control application of the material onto the masonry units. The material is forced by a propellant (which also causes foaming) from the tank 24 and the water vapor in the air and water molecules on the masonry unit itself then cause the polymerization. The single component material is especially attractive for concrete block and similar construction, as it is relatively inexpensive and does not require any additional mixing or application equipment beyond what is shown and described here. The material continues to expand to fill voids between the masonry units 12, and sets up hard in a relatively short time, typically less than a day. The bond to the concrete is particularly tenacious, and in fact the bond strength, concrete-to-concrete, using the single component urethane foam as a bonding agent, has been found to exceed the foam strength. The polyurethane foam itself has a typical tensile strength of about 25 pounds per square inch (PSI), whereas the concrete-to-concrete strength using this material typically exceeds 100 PSI. For purposes of engineering design, this means that a pair of concrete blocks, 8 inches by 8 inches by 18 inches, cemented together using this material, can withstand a tensile force of over 10,000 pounds. For any typical wall, this system provides more than enough tensile strength to withstand lift forces of the wind on the building roof and other wind loading.

The construction method of this invention is exceedingly simple to use and is also highly energy efficient. Conventional portland-cement based mortar requires large amounts of energy in the manufacture of the portland cement, resulting in large quantities of carbon dioxide, waste heat, and noxious fumes. A much lesser amount of energy is needed in the manufacture of the single-component urethane foam system, and in use the polymers are not oxidized.

The system of this invention is also adjustable over a range for bond strength or elasticity, to meet design requirements. A thicker layer of the foam material 20 will provide a greater elasticity, while a thinner layer has a greater bond strength between masonry units.

The concrete-concrete bond of this system has been subjected to a continuous stress test equal to 40% of foam rupture stress over a four-year period. The test specimen was periodically subjected to stresses of two to four times the continuous stress for short intervals (of several minutes each). No failures occurred in this testing.

In many types of construction, it is common to affix a transition element, such as the sill plate 22 described above, to transition to another building material above the wall or foundation. In this case, the single-component material 20 provides an excellent concrete-to-wood bond. The concrete-wood bond, although weaker than the concrete-concrete bond, is stronger than a wood-wood bond. The stress-strain relationships for the two bonds are similar (i.e., the Young's modulus is about the same) but deformation or non-linearity occurs at a lower value for the wood-urethane bond than it does for the concrete-urethane bond. Fracture incidence is fundamentally a statistical issue. There are fewer failures at any given stress level on the concrete side of the wood-concrete bond, and this appears as a stronger bond. Another factor is the bubble strength in the foamed material. The bond material 20 is not homogeneous at the microscopic level as the foamed material is formed with a high incidence of small bubbles. At the juncture between the wood and the concrete (or other masonry unit) the bubble end nearest the concrete side is going to be reinforced due to the strength of the amine-alumina bond discussed earlier. This reduces the probability of bubble rupture, and increases the net bond strength.

The wood-concrete bond in this system is important for a variety of reasons, but one of the more significant being in the attachment of the plate 22 to the top of the wall 10. If the wall-plate bond is strong and the wall has a high tensile strength, then the building roof can be strongly attached and the overall strength of the building is greatly enhanced. That means the building can be considered more of an integral unit.

High unit tensile strength is particularly important in areas of high wind loading, such as high-risk hurricane areas.

Figure 3:
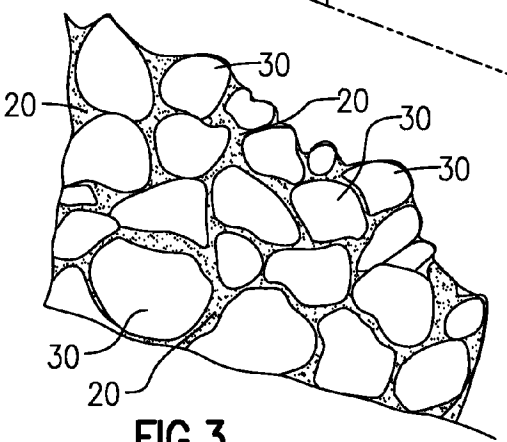
FIG. 3 is a perspective view of a another masonry wall constructed according to this invention.

As shown in FIG. 3, masonry construction using stones 30 or other irregularly shaped masonry units can be carried out using the system of this invention. In this case, the stones should be selected of a mineral content that contains an aluminum oxide component. The stones can be place atop one another in known fashion, and held in place using the single-component foam material 20 as the bonding agent. Stones that have a quantity of aluminum oxide will bond well to the foam material, as discussed previously. In addition, units fabricated of stone, concrete, or other suitable masonry material and each having the same more or less irregular shape, can be employed as the masonry units in walls or similar structures constructed according to this invention.

A particularly salubrious construction occurs if the masonry unit consists of two masonry faces separated by an insulating foam core and these units are then assembled using this foam bonding technique. First, any desired degree of thermal insulation is available. Second, the masonry construct is polylithic, and there is no summing of thermally induced stresses. Third, the structure has good tensile strength and is therefor stronger than traditional mortar based construction. Fourth, a potential condensate boundary will be formed within the nearly impenetrable closed-cell foam core, where mold, mildew and rot cannot occur. Fifth, the wall formed in this fashion is especially inefficient at transmitting acoustic vibrations, and thus is an excellent acoustic damper. This occurs because each unit is formed of a pair of large outer masses (i.e., the inner and outer masonry faces) separated by a low-mass foam layer that is also a poor acoustical transfer agent. Moreover, the masonry faces of the various blocks or masonry units are bonded by foam and not mortar, so the masonry faces vibrate independently and tend to cancel out each other's vibrations. Sixth, the foam core block gives the block greater strength than a traditional, all-concrete block with concrete web joining the inner and outer plates or surfaces. Seventh, a structure built with these techniques has a much lower overall energy consumption, taking into account manufacturing costs, construction costs, and environmental costs of heating and cooling).

The technique of this invention can be carried out even when the building materials are moist from being exposed to rain or other humidity, as the water will be absorbed by the single component material, so long as the building materials are not flooded with water. On the other hand, if a two-component system is used as a bonding agent, it is necessary to take care to keep the masonry units dry so that there will be sufficient adhesion.

While the invention has been described with reference to a specific preferred embodiment, the invention is certainly not limited to that precise embodiment. Rather, the scope of this invention is to be ascertained from the appended Claims.

The invention claim is:

1. A process for constructing a wall formed of multiple courses of masonry blocks, each of said blocks being formed of a material that includes aluminum oxide as a significant component thereof; and employing as a bonding agent between facing surfaces of said blocks an amide closed-cell foam material which following application cures by absorbing moisture from its environment, the process comprising:

setting a first course of said masonry blocks;

applying onto the blocks of the first course an amount of said amide foam material;

setting additional ones of said masonry blocks onto the first course, and being adhered thereto by said amide closed-cell foam material, to form a second course of said masonry blocks;

applying onto the blocks of the second course an amount of said amide foam material; and permitting said closed-cell foam material to cure in place between said masonry blocks to form said wall.

2. Process according to claim 1 wherein said masonry blocks include concrete blocks.

3. Process according to claim 1 wherein said amide closed-cell foam material is applied to one or both of facing surfaces of adjacent masonry blocks of each said course.

4. Process according to claim 1, further comprising applying a single component urethane closed-cell foam material onto an upper surface of an uppermost course of said blocks; and laying a sill plate atop said uppermost course such that the sill plate is adhered thereto by said single component urethane closed-cell foam material.

5. Process according to claim 1 wherein said amide closed-cell foam material includes a single-component urethane foam material which bonds to said masonry blocks by displacing water molecules that had been attached to molecules of the aluminum oxide component of the masonry blocks.

6. Process according to claim 1 wherein said courses are laid atop one another without mortar.

7. Process of constructing a mortarless wall of masonry units employing as a bonding agent a single component urethane closed-cell foam material and wherein said masonry units each have an aluminum oxide component; said single component urethane closed-cell foam material, after application, curing by absorbing moisture from its surroundings, the process comprising:

stacking said masonry units so that they extend in at least one horizontal direction and in a vertical direction, while applying onto surfaces of the masonry units that face one another an amount of said single component urethane closed-cell foam material, and permitting the single component urethane closed-cell foam material to cure so that the stacked masonry units form a self-standing wall.

8. The process according to claim 7 wherein said masonry units are stacked more than two of said units vertically.

9. The process according to claim 7 wherein said single component urethane foam material bonds to said masonry units by displacing water molecules that had been attached to molecules of the aluminum oxide component in the masonry units.

10. The process according to claim 7, wherein said masonry units are of non-uniform dimensions, and are stacked randomly to form said wall.

* * * * *

UNITED STATES PATENT AND TRADEMARK OFFICE

CERTIFICATE OF CORRECTION

PATENT NO. : 8,196,370 B2
APPLICATION NO. : 12/878070
DATED : June 12, 2012
INVENTOR(S) : Addison C. Sheckler It is certified that error appears in the above-identified patent and that said Letters Patent is hereby corrected as shown below:

Title Page

(75) Inventor:

"Addison C. Scheckler" should read --Addison C. Sheckler--.

Signed and Sealed this
Fourteenth Day of August, 2012

David J. Kappos

David J. Kappos
*Director of the United States Patent and Trademark Office*